United States Patent [19]

Rubin

[11] 4,025,206

[45] May 24, 1977

[54] WIRE BRUSH HOLDER COUPLED TO CAN

[75] Inventor: Steven Allen Rubin, Stoughton, Mass.

[73] Assignee: Universal Products, Inc., Brockton, Mass.

[22] Filed: June 27, 1975

[21] Appl. No.: 591,016

[52] U.S. Cl. ..... 401/123; 248/112

[51] Int. Cl.² ..... A46B 17/02

[58] Field of Search ..... 15/257.05; 220/90; 211/65; 248/110, 111, 112, 113; 401/121, 123, 124

[56] References Cited

UNITED STATES PATENTS

| | | | |
|---|---|---|---|
| 778,272 | 12/1904 | Roop | 248/113 X |
| 2,783,077 | 2/1957 | Pierce | 220/90 X |
| 2,786,707 | 3/1957 | Campbell | 248/113 X |

*Primary Examiner*—Daniel Blum
*Attorney, Agent, or Firm*—Joseph H. Killion

[57] ABSTRACT

A brush caddy made up of four pieces of wire welded together. The longest piece termed a "spine" has a hook at the top from which a paint brush may be hung. Centrally a cross piece is welded to the spine to form a pair of arms ending in claws which grip the rim of a paint can. The spine is tilted away from the can so that the brush is more easily grasped and more easily placed on the hook. A third piece of wire forms a "yoke" which cooperates with the hook and the spine to support the brush in the desired slanting position with the dripping edge over the mouth of the can. The fourth piece of wire is welded across the spine at its base to embrace the can at that end. An elastic member fits over the ends of this fourth piece of wire and around the can, for added stability.

7 Claims, 2 Drawing Figures

WIRE BRUSH HOLDER COUPLED TO CAN

This invention relates to painting and more particularly to a new and useful appliance for use by the painting trade and herein termed a "brush caddy".

It is an object of this invention to provide a brush caddy which may be applied to a common standard one-gallon paint can to support a brush over said can so that paint that drips from the brush falls into the can, while the handle of the brush remains clean.

It is a further object of the invention that the caddy be easily cleaned for reuse. Further objects of the invention are that it be sturdy and durable.

The foregoing objects are efficiently attained by a construction wherein a generally upwardly extending wire member, termed a spine has three bent-wire cross members, and formed at its upermost end as a hook from which a brush or brushes may hang. The topmost cross member is an upwardly extending u-shaped yoke which restrains the brush(es) from swinging around the hook end. The second cross member reaches around the top of the can at each end of the spine, and grips the rim of the can with claws at each end. To maintain the spine in contact with the can at this point, the arm is proportioned so that it must be slightly bowed to engage the rim, thereby maintaining contact by the spring action of the member. The third cross piece provides a pair of legs which extend to either side of the lower end of the spine and embrace the can. An elastic member extends partially around the can's circumference and fits over these legs, greatly increasing the stability.

Figure 1:
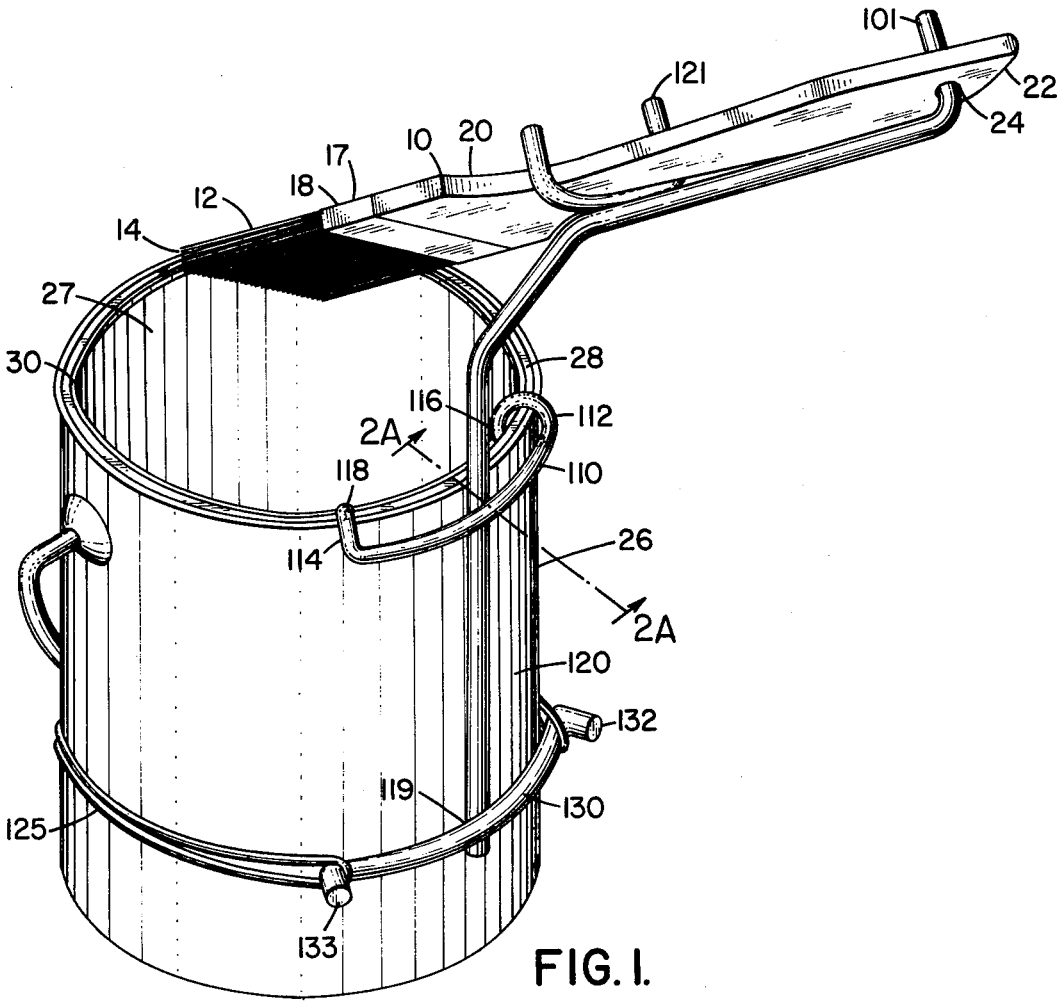
Figure 2:
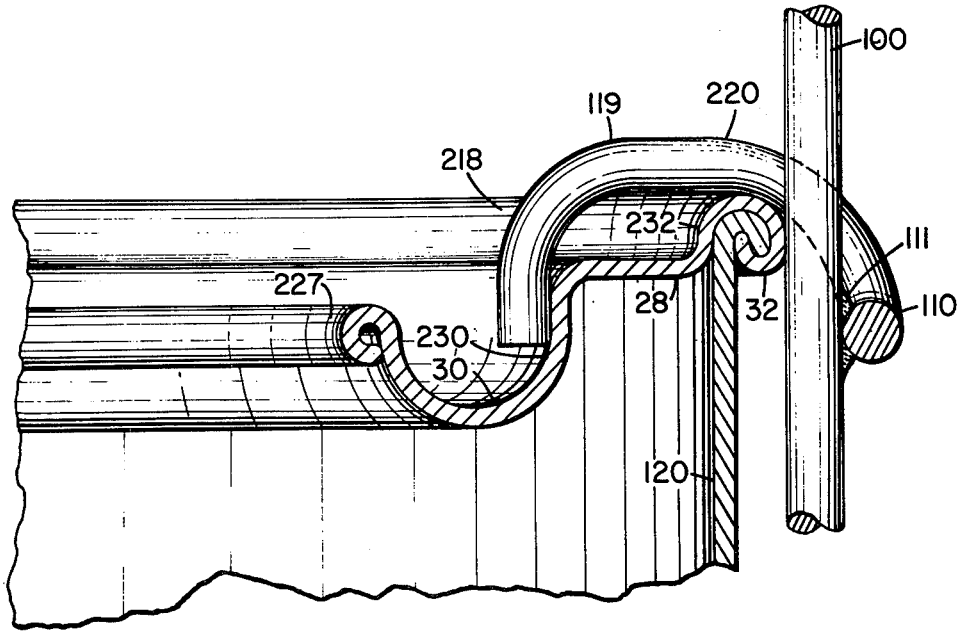

Other objects and features of the invention will in part be obvious and in part be apprehended from the following specification and annexed drawing, in which:

FIG. 1 is a perspective view of the preferred embodiment of the invention shown attached to a 1-gallon paint can and supporting two brushes, and FIG. 2 is a sectional view taken along line 2A—2A of FIG. 1.

It is possible for the invention to be used with several sizes of paint brushes because the wire may be bent somewhat as required to fit and because the handle of any paint brush must be made to somewhat fit the human hand.

A standard paint brush as shown in FIG. 1 has a relatively wide, flat painting head 10 wherein bristles or other material provide a paint distributing medium 12 ending in a compliant painting edge 14. In the head, the medium 12 is joined to a handle 16 at a shoulder portion 17 by a metal strap 18 which is tacked to the metal handle and crimped and sometimes cemented to the distributing medium. From the shoulder portion the brush typically tapers to a nearly round neck portion 20 then broadens out somewhat where the brush meets the palm of the hand, then tapers to a point 22 where the brush meets the heel of the hand. Near the point is almost invariably drilled a hole 24, ¼ in diameter by which the painter may hang the brush, bristles down in thinner or the like.

Although brushes vary considerably in width and thickness, the handle dimensions vary to a much lesser degree.

A typical 1-gallon paint can 26 as shown in the figure measures 7½ inches high by 6½ inches in diameter. The mouth 27 of the can is a little over 6 inches in diameter. Around the mouth 27 in the rim 28 is a lid groove 30 which is about 5⅞ inches in diameter at its center, and the top crimped lip 32 which is a little under 6½ inches at its inner diameter.

The brush caddy is preferably made of No. 11ASW gauge wire (about ⅛ inch in diameter) this is small enough to pass freely through the hole 24 to drop into the lip groove 30, and sufficiently rigid for the purpose. It is important that the selected materials be not too heavy or the off-center weight of the caddy and its supported brushes might be enough to upset a nearly empty can of paint. Due to this factor in addition to other possible advantages the use of plastic materials in the manufacture of brush caddies is contemplated.

As shown the caddy has a spine of wire which extends downward about 6 inches from the crimped lip 32 of the can and upward and outward from the can axis about 7 inches at which point it is bent upward and somewhat inwardly to form a nook 101. At about the point where the spine touches the crimped lip 32 a cross piece 110 is welded to it which forms two arms 112 and 114 extending around the lip about 2 inches at each end of the spine. At the ends of these arms the wire of the cross piece 110 is bent inwardly towards the axis of the can, and then downwardly somewhat outwardly about ⅜ inch to form at the ends of the arms two claws 116 and 118 which can be forced into the lid groove 30 by bowing the cross piece 110 by about ⅛th inch. In this way the caddy is held to the can by a stable four point support. On the outside of the can there is contact between the spine and the crimped lip 32 and a point 119 somewhat lower on the sidewall 120 of the can. The claws in opposition press outward against the inward facing wall of the top groove at points which are below the crimp lip and above the other point 119. This allows the forces to balance in a stable configuration. For a standard 1 gallon can the points in the unbowed condition are substantially 3.70 inches apart on centers and each point is substantially 2.07 inches from the spine at its point of attachment to the cross member measured between centers.

Between the cross piece 110 and the hook 101 (between 2 inches and 4 inches from the hook), preferably 3 inches, is welded an upwardly extending U-shaped yoke 121 which allows the handle of a brush hung on the hook 101 to drop into the yoke and thereby to be restrained with its wet end pointed toward and above the can.

Although the caddy would be fully operative if the structure were cut off below the point 119, it is preferred that a second cross piece 130 be affixed to the spine about five inches below the cross piece 110 and forming two legs which bend around and embrace the can, ending in "feet" portions 132, 133 adapted for contact with the can. With this second cross piece, the caddy has a second mode of attachment by which it may be retained in a stable configuration by elastic member 125. In this mode there is stable support with the two claws 116 and 118 hanging on the rim 28 and the two feet 132, 133 to press against the outside, at least three of them in contact.

FIG. 2 is a greatly magnified cross sectional view of a typical paint can rim, showing the crimp lip 32 formed by rolling together the rim 28 and the sidewall 120. The left hand portion of the figure is taken along the line *2a—2a* of FIG. 1 and shows the mode of contact of the claw 118 with the lid groove 30. Each claw 116, 118 has an inwardly directed portion 218 running toward the cylinder axis of the can, and a downward, and somewhat outwardly running point 220 which engages the lid groove 30. The right-hand portion of FIG. 2 shows the contact of the spine 100 with the crimp lip 32 in a section taken along the line 2*b*—2*b* of FIG. 1. This point of contact is seen to lie along and just above the point at which the cross piece 110 is connected to the spine by a weld 111. The rim is seen to have three inward-facing surfaces, the face 227 of the mouth 27, the face 230 of the lid groove 30, and the inner face 232 of the crimp lip 32. The caddy may be proportioned to engage any of these surfaces as desired.

It should be noted that a caddy proportioned for a one gallon paint can as described works perfectly well with the popular 2 pound coffee can. For that can (5 inches in diameter) the claws grip the crimp lip. The arms may be proportioned so that the claws may grip any of the inwardly extending surfaces at the top of a container. On a paint can, they may grip the mouth 27 of the can, the lid groove, or the crimp lip; but it is preferred to grip the lid groove as described above.

It will be apparent that one may modify from the preferred construction shown above without departing from the spirit of this invention. In particular, there may be more economic means for connecting the parts, and substitute materials for some of them. But the scope of the invention shall be understood to be as defined by the claims.

The embodiments of the invention in which an exclusive property or privilege is claimed are defined as follows:

1. For supporting a paint brush of the common type having a broad, substantially flat paint-applying head, a handle with a hole therethrough at its proximal end and a neck portion to engage the index finger of the user situated centrally along the line between said end and a compliant painting edge, over a common paint can of generally cylindrical shape, having when open at its top an inwardly turning upper rim defining the mouth of said can with the cylinder axis normally vertical, so that point dripping from said edge falls into said mouth, a brush caddy comprising, a. A spine bent at its upper end to form a hook to engage said hole while said handle lies generally parallel to said spine, b. a cross member fixed to said spine to extend generally perpendicular to said spine and along said rim to form a pair of arms having at the end of each arm a claw reaching inwardly and downwardly to engage an inward facing surface of said rim, c. a yoke fixed to said spine as an upwardly extending U-shaped member adapted to engage said neck as said hook engages said hole, d. said caddy being proportioned relative to the size of said brush and the size of said can so that as applied to said can, said claws engage said rim, the lower end of said spine lies below and between said claws outside of said can, said spine bends outward away from said can axis above said claws with said hook turned generally upward to retain said brush by said hole steadied along said spine by the engagement of said yoke and said neck, the outward bending of said spine being such as to carry said painting edge over said mouth.

2. A caddy as defined by claim 1 designed for attachment to a paint can of the type wherein said rim is carried on the sidewall of said can by a crimp lip, and wherein said rim, carries a lid groove below and inward of said crimp lip into which a lid may be pressed and removed to close and open the mouth of said can, characterized in that e. said claws comprise an inwardly extending portion running toward said can axis, and a downward, and somewhat outwardly extending running point adapted to enter said lid groove, f. said arms being proportioned so that to insert said points into said lid groove requires the bowing of said arm against its elastic resilience, and such that said elastic resilience tends to hold said points firmly against the inward facing surface of said lid groove.

3. A caddy as defined by claim 2 designed for application to a standard one-gallon paint can wherein said points in the unbowed condition are substantially 3.70 inches apart on centers and each point is substantially 2.07 inches from said spine at its point of attachment to said cross member measured between centers, and wherein said spine and cross members are of No. 11 ASW gauge mild steel wire.

4. A caddy as defined in claim 1 e. in further combination with a second cross member comprising a pair of legs extending at opposite sides of said spine at its lower end and curved to embrace said can at either side of said spine.

5. A caddy as defined in claim 4 f. in further combination with an elastic member connecting said legs, holding said legs under tension toward the surface of said can.

6. A caddy as defined by claim 5 designed for attachment to a paint can of the type wherein said rim is carried on the sidewall of said can by a crimp lip, and wherein said rim carries a lid groove below and inward of said crimp lip into which a lid may be pressed and removed to close and open the mouth of said can, characterized in that, f. said claws comprise each an inward directed portion, running toward said can axis, and a downward, and somewhat outwardly running point adapted to enter said lid groove, g. said arms being proportioned so that to insert said points into said lid groove requires the bowing of said arm against its elastic resistance, and such that said elastic resistance tends to hold said points firmly against the inward facing surface of said lid groove.

7. A caddy as defined by claim 6 designed for application to a standard 1-gallon paint can wherein said points in the unbowed condition are substantially 3.70 inches apart on centers and each point is substantially 2.07 inches from said spine at its point of attachment to said cross member measurea between centers, and wherein said spine and cross members are of No. 11 ASW gauge mold steel wire.

* * * * *